US006609300B2

(12) United States Patent
Burgess

(10) Patent No.: US 6,609,300 B2
(45) Date of Patent: Aug. 26, 2003

(54) PUMP IMPELLER AND METHOD

(75) Inventor: Kevin Edward Burgess, Carlingford (AU)

(73) Assignee: Warman International Limited (AU)

( * ) Notice: Subject to any disclaimer, the term of this patent is extended or adjusted under 35 U.S.C. 154(b) by 0 days.

(21) Appl. No.: 10/094,115

(22) Filed: Mar. 8, 2002

(65) Prior Publication Data

US 2002/0119048 A1 Aug. 29, 2002

Related U.S. Application Data

(63) Continuation of application No. 09/486,471, filed as application No. PCT/AU98/00677 on Aug. 24, 1998, now abandoned.

(30) Foreign Application Priority Data

Aug. 26, 1997 (AU) ..... PO8794

(51) Int. Cl.[7] ..... F04D 29/24

(52) U.S. Cl. ..... 29/889.4; 29/889; 416/186 R; 416/188; 416/223 B

(58) Field of Search ..... 416/186 R, 188, 416/223 B; 415/206, 228; 423/243.08; 422/171, 172, 178; 29/889, 889.4, 889.7

(56) References Cited

FOREIGN PATENT DOCUMENTS

| | | | | |
|---|---|---|---|---|
| CH | 169128 A | * | 8/1934 | ..... 415/206 |
| SU | 531929 A | * | 10/1976 | ..... 416/186 R |
| SU | 1052053 A | * | 10/1984 | ..... 416/223 B |
| SU | 1605035 A1 | * | 11/1990 | ..... 415/206 |

* cited by examiner

*Primary Examiner*—Christopher Verdier
(74) *Attorney, Agent, or Firm*—Cesari and McKenna, LLP

(57) ABSTRACT

A pump impeller which is modified so as to achieve selected operating performance parameters. The impeller includes a front shroud and a rear shroud, the shrouds being spaced apart so as to form a plurality of passageways therebetween which are separated by a plurality of impeller blades, each having an outer edge extending between the front and rear shrouds, the impeller having an outer diameter D. The method modification includes the steps of trimming the outer edge of the blades so that the outer diameter $D_1$ of the front shroud is less than the outer diameter $D_2$ of the rear shroud.

2 Claims, 1 Drawing Sheet

PUMP IMPELLER AND METHOD

RELATED APPLICATION

This application is a continuation of Ser. No. 09/486,471, filed May 31, 2000, now abandoned which is a 371 of PCT/AU98/00677 filed Aug. 24, 1998.

BACKGROUND OF THE INVENTION

This invention relates generally to pumps and more particular, but not exclusively to high specific speed pumps.

The invention is particularly applicable to high speed pumps typically used for flue gas desulphurisation (FGD) applications in power stations. Such pumps are utilised in a wet limestone scrubbing process to circulate the slurry to remove the sulphur from the flue gases before the sulphur can enter the atmosphere. Reference to this particular application is not to be taken as a limitation to the scope of the invention. It will be readily apparent to those persons skilled in the art that the invention is also applicable to other applications.

Pumps required for FGD applications typically must deliver high flowrate at moderate to low head. To achieve this they can, for example, be direct coupled which increases the speed at which they operate above, say, a lower speed gearbox driven pump. These higher speed pumps for a FGD application can also be referred to as a mixed flow pump, as opposed to, say, a normal slower running radial style of slurry pump. The flow in a radial pump is predominantly radial, whereas a mixed flow pump, the flow is both radial and axial.

The duty specifications for FGD pumps are normally very stringent and users require high efficiency. For FGD plants to operate correctly and efficiently, the FGD pumps must pump a precise set volume of limestone slurry through the FGD system. As the volume flowrate needs to be set precisely, so does the head (or pressure) that the pump supplies. Normally, the pump specification does not allow any negative tolerances, e.g., if the specified pump head is 25 m, then on test, the pump must produce 25 m or more. How much is also normally spelled out in the Pump Test Standard Acceptance Criteria that are given in the contract. This can be, say, +5% more head.

Design of a pump for FGD must take account of the duty requirements, particularly in regard to head as it is the head, which ultimately controls the volume flow slurry in the FGD system. With a direct driven mixed flow pump, the impeller diameter can only be changed marginally to meet the duty requirements. Hence there will be occasions that the pump would generate more head than specified and in some cases even more than the allowable upper limit specified in the contract. When the head is higher than the allowable tolerance, it must be reduced so the final tested head is within the tolerance band to meet the acceptance criteria.

To reduce the head to within the allowable tolerance (say −0% to +5%), the impeller can be modified by causing it to be trimmed i.e. a. small reduction is made to the impeller diameter. Trimming to reduce the head also changes the power absorbed by the pump and this impacts on the pump efficiency.

The currently known technique as detailed in technical papers and texts is to make an angled cut on the drive side or rear shroud side of the impeller. This is shown in FIG. 1. Depending on the amount of trim (diameter reduction), the head and power are affected at different rates as shown in FIG. 2. Hence while the prediction of the necessary trim is complicated, the main problem relates to the fact that the head and power reductions do not follow the same pattern. Hence, trimming by this known method generally results in a reduction in head, a lesser reduction in power and a consequential decrease in efficiency. Hence it may occur that the head and flow produced by the pump are correct, but that the power absorbed is higher than the allowable tolerance. In such a case, the pump would be unacceptable.

SUMMARY OF THE INVENTION

It is an object according to one aspect of the present invention to provide a method of modifying a pump impeller so that it alleviates the problems discussed above.

It is a further object according to another aspect of the present invention to provide an improved pump impeller.

According to one aspect of the present invention there is provided a method of-modifying a pump impeller so as to achieve selected operating performance parameters, the impeller including a front shroud and a rear shroud, the shrouds being spaced apart so as to form a plurality of passageways therebetween which are separated by a plurality of impeller blades, each having an outer edge extending between the front and rear shrouds, the impeller having an outer diameter D, the method including the steps of trimming the outer edge of the impeller blades so that the outer diameter $D_1$ of the front shroud is less than the outer diameter $D_2$ of the rear shroud.

Preferably, the outer peripheral edge is trimmed so as to taper inwardly from the outer diameter $D_2$ of the rear shroud to the outer diameter $D_1$ of the front shroud.

According to another aspect of the present invention there is provided an impeller for a pump, the impeller including a front shroud having an outer diameter $D_1$ and a rear shroud having an outer diameter $D_2$, the shrouds being spaced apart so as to form a plurality of passageways therebetween which are separated by a plurality of impeller blades each having an outer edge extending between the front and rear shrouds charaterised in that the outer diameter $D_1$ of the front shroud is less than the outer diameter $D_2$ of the rear shroud.

Preferably, the ratio of $D_1/D_2$ ranges from between 1.0 to and including 0.85.

It has been surprisingly discovered that the reduction in head and power follows a more predictable pattern and more importantly, the reduction in head and power achieved for any trim are more equal. The effect is that the pump efficiency is far less affected by the trim as compared to the known method. Hence it is more likely using the new method of impeller trimming, that the head and flow can be achieved within tolerance and at the same time that the efficiency is likewise acceptable.

BRIEF DESCRIPTION OF THE DRAWINGS

Preferred embodiments of the invention will hereinafter be described with reference he accompanying drawings and in those drawings.

DESCRIPTION OF A PREFERRED EMBODIMENT

Figure 1:
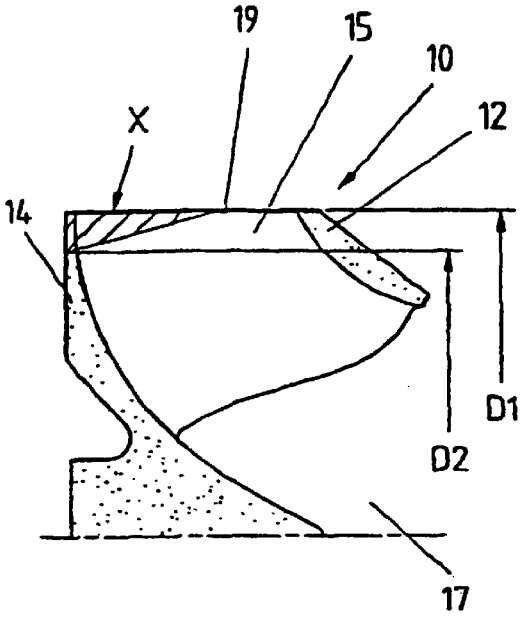
FIGURE 1. (PRIOR ART)
FIG. 1 is a schematic partial view of an impeller which has been trimmed using a known trimming technique.
Figure 2:
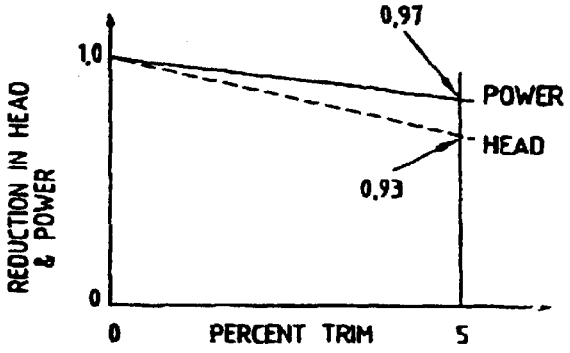
FIGURE 2. (PRIOR ART)
FIG. 2 is a graph illustrating the general performance characteristics of the impeller shown in FIG. 1.
Figure 3:
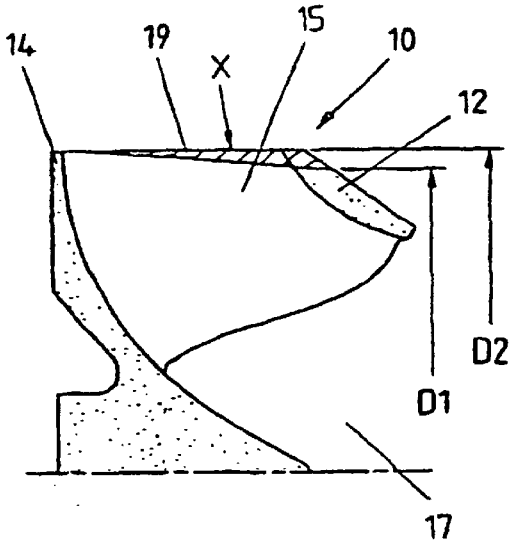
FIG. 3 is a schematic partial view of an impeller which has been trimmed according to the present invention.

Referring to FIGS. 1 and 3 there is shown two impellers each generally indicated at 10, each impeller including a front shroud 12 and a rear shroud 14 with a series of blades 15 ending therebetween separating the interior of the impeller into a series of passageways. The impeller further includes an impeller inlet 17 and a series of outlets between the blades at peripheral edge 19 of the impeller. The diameter of the front shroud is indicated by $D_1$ and the diameter of the rear shroud is indicated by $D_2$. In the prior art arrangement shown FIG. 1, the trimming is effected by removal of a portion of the outer peripheral edge so that the diameter of the inlet shroud $D_1$ is greater than the diameter of the outlet shroud $D_2$. As mentioned earlier, depending on the amount of trim (diameter reduction), the head and the power effected at different rates as shown in FIG. 2.

Figure 4:
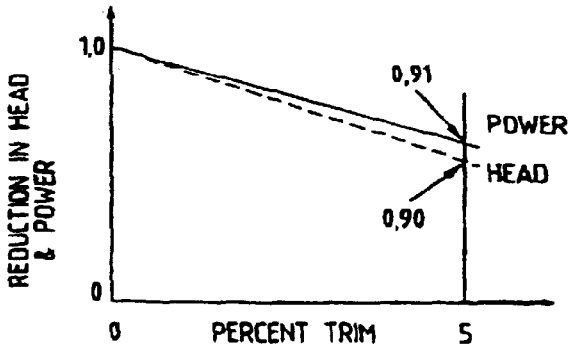
FIG. 4 is a graph illustrating the general performance characteristics of the impeller shown in FIG. 3 where percent trim is determined by $$100-\left(\frac{D_1}{D_2}\right)\times 100$$

According to the present invention, the impeller is trimmed by removing material so that the diameter of the front shroud is less than the diameter of the rear shroud. The effect of this trimming is shown in FIG. 4.

Thus, according to the present invention, the pump efficiency is far less affected by the trimming operation as compared to the prior art method. As such, it is more likely that under the method according to the present invention, the head and flow can be achieved within tolerance at the same time that the efficiency is held within acceptable limits.

Finally, it is to be understood that various alterations, modifications and/or additions may be incorporated into the various constructions and arrangements of parts without departing from the spirit or ambit of the invention.

What is claimed is:

1. A method of minimizing the efficiency loss due to trimming of a slurry pump impeller of the type including a front shroud and a rear shroud, the shrouds being spaced apart so as to form a plurality of passageways therebetween which are separated by a plurality of impeller blades, each having an outer edge extending between the front and rear shrouds, said method including steps of trimming the outer edges of the impeller blades so that the outer diameter $D_1$ of the front shroud is less than the outer diameter $D_2$ of the rear shroud and the impeller produces a selected pressure head for a given flow rate.

2. The method according to claim 1 wherein the blades are trimmed until ratio $D_1/D_2$ is in the range of 0.85 up to 1.0.

* * * * *